US007887322B2

(12) United States Patent
Popovic et al.

(10) Patent No.: US 7,887,322 B2
(45) **Date of Patent: *Feb. 15, 2011**

(54) MIXING HOLE ARRANGEMENT AND METHOD FOR IMPROVING HOMOGENEITY OF AN AIR AND FUEL MIXTURE IN A COMBUSTOR

(75) Inventors: Predrag Popovic, Simpsonville, SC (US); Derrick Walter Simons, Greer, SC (US); Krishna Kumar Venkataraman, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 299 days.

This patent is subject to a terminal disclaimer.

(21) Appl. No.: 11/531,045

(22) Filed: Sep. 12, 2006

(65) Prior Publication Data

US 2008/0060358 A1 Mar. 13, 2008

(51) Int. Cl.
*F23D 14/62* (2006.01)
*F23C 6/04* (2006.01)

(52) U.S. Cl. ..... 431/354; 431/352; 431/8; 60/737

(58) Field of Classification Search ..... 431/8, 431/354, 352, 353; 60/737, 738, 752, 754; 123/590–593, 527–530
See application file for complete search history.

(56) References Cited

U.S. PATENT DOCUMENTS

| | | | | |
|---|---|---|---|---|
| 4,982,570 | A * | 1/1991 | Waslo et al. | 60/733 |
| 5,289,686 | A * | 3/1994 | Razdan et al. | 60/755 |
| 6,038,861 | A | 3/2000 | Amos et al. | |
| 6,427,446 | B1 * | 8/2002 | Kraft et al. | 60/737 |
| 6,769,903 | B2 * | 8/2004 | Eroglu et al. | 431/8 |
| 7,481,650 | B2 * | 1/2009 | Mosiewicz et al. | 431/351 |
| 2001/0052229 | A1 * | 12/2001 | Tuthill et al. | 60/39.06 |
| 2005/0217276 | A1 * | 10/2005 | Colibaba-Evulet et al. | 60/776 |

* cited by examiner

*Primary Examiner*—Kenneth B Rinehart
*Assistant Examiner*—Chuka C Ndubizu
(74) *Attorney, Agent, or Firm*—Cantor Colburn LLP

(57) ABSTRACT

Disclosed is a mixing hole arrangement for improving homogeneity of an air and fuel mixture in a combustor, the mixing hole arrangement comprising a plurality of mixing holes defined by a liner, wherein at least one of the plurality of mixing holes is a mixing hole that is at least one of sized and positioned to impede penetration of a fluid flow into a primary mixing zone located in a head end of the combustor.

26 Claims, 17 Drawing Sheets

FIG. 10

Distance from nozzle end (3.65", 4.9", 6.15")

200

201

Degree disposal about the liner

| degree | 1st col. 3.65" | 2nd col. 4.9" | 3rd col. 6.15" |
|---|---|---|---|
| 0 | 0.98 | | |
| 12 | | 0.71 | |
| 24 | | | 0.59 |
| 36 | 0.98 | | |
| 48 | | | 0.59 |
| 60 | | 0.71 | |
| 72 | 0.98 | | |
| 84 | | | 0.59 |
| 90 | | 0.71 | |
| 108 | 0.98 | | |
| 126 | | 0.71 | |
| 132 | | | 0.59 |
| 144 | 0.98 | | |
| 156 | | | 0.59 |
| 168 | | 0.71 | |
| 180 | 0.98 | | |
| 192 | | 0.71 | |
| 204 | | | 0.59 |
| 216 | 0.98 | | |
| 228 | | | 0.59 |
| 234 | | 0.71 | |
| 252 | 0.98 | | |
| 270 | | 0.71 | |
| 276 | | | 0.59 |
| 288 | 0.98 | | |
| 300 | | | 0.59 |
| 312 | | 0.71 | |
| 324 | 0.98 | | |
| 336 | | | 0.59 |
| 348 | | 0.71 | |

FIG. 11

Distance from nozzle end (3.65", 4.9", 6.15")

300

301

Degree disposal about the liner

| degree | 1st col. 3.65" | 2nd col. 4.9" | 3rd col. 6.15" |
|---|---|---|---|
| 0 | | | 0.777 |
| 12 | | 0.777 | |
| 24 | 0.777 | | |
| 36 | | | 0.777 |
| 48 | 0.777 | | |
| 60 | | 0.777 | |
| 72 | | | 0.777 |
| 84 | 0.777 | | |
| 90 | | 0.777 | |
| 108 | | | 0.777 |
| 126 | | 0.777 | |
| 132 | 0.777 | | |
| 144 | | | 0.777 |
| 156 | 0.777 | | |
| 168 | | 0.777 | |
| 180 | | | 0.777 |
| 192 | | 0.777 | |
| 204 | 0.777 | | |
| 216 | | | 0.777 |
| 228 | 0.777 | | |
| 234 | | 0.777 | |
| 252 | | | 0.777 |
| 270 | | 0.777 | |
| 276 | 0.777 | | |
| 288 | | | 0.777 |
| 300 | 0.777 | | |
| 312 | | 0.777 | |
| 324 | | | 0.777 |
| 336 | 0.777 | | |
| 348 | | 0.777 | |

FIG. 12

Distance from nozzle end (3.65", 4.9", 6.15")

400

401

Degree disposal about the liner

| degree | 1st col. 3.65" | 2nd col. 4.9" | 3rd col. 6.15" |
|---|---|---|---|
| 0 | | | 1.39 |
| 12 | | 0.71 | |
| 24 | 0.59 | | |
| 36 | | | 0.71 |
| 48 | 0.59 | | |
| 60 | | 0.71 | |
| 72 | | | 1.39 |
| 84 | 0.59 | | |
| 90 | | 0.71 | |
| 108 | | | 0.71 |
| 126 | | 0.71 | |
| 132 | 0.59 | | |
| 144 | | | 1.39 |
| 156 | 0.59 | | |
| 168 | | 0.71 | |
| 180 | | | 0.71 |
| 192 | | 0.71 | |
| 204 | 0.59 | | |
| 216 | | | 1.39 |
| 228 | 0.59 | | |
| 234 | | 0.71 | |
| 252 | | | 0.71 |
| 270 | | 0.71 | |
| 276 | 0.59 | | |
| 288 | | | 1.39 |
| 300 | 0.59 | | |
| 312 | | 0.71 | |
| 324 | | | 0.71 |
| 336 | 0.59 | | |
| 348 | | 0.71 | |

FIG. 13

Distance from nozzle end (5.14", 6.39", 7.64")

500

501

Degree disposal about the liner

| degree | 1st col. 5.14" | 2nd col. 6.39" | 3rd col. 7.64" |
|---|---|---|---|
| 0 | 0.784 | | 0.912 |
| 20 | | 0.85 | |
| 30 | 0.784 | | 0.912 |
| 40 | | 0.85 | |
| 60 | 0.784 | | 0.912 |
| 80 | | 0.85 | |
| 90 | 0.784 | | 0.912 |
| 100 | | 0.85 | |
| 120 | 0.784 | | 0.912 |
| 140 | | 0.85 | |
| 150 | 0.784 | | 0.912 |
| 160 | | 0.85 | |
| 180 | 0.784 | | 0.912 |
| 200 | | 0.85 | |
| 210 | 0.784 | | 0.912 |
| 220 | | 0.85 | |
| 240 | 0.784 | | 0.912 |
| 260 | | 0.85 | |
| 270 | 0.784 | | 0.912 |
| 280 | | 0.85 | |
| 300 | 0.784 | | 0.912 |
| 320 | | 0.85 | |
| 330 | 0.784 | | 0.912 |
| 340 | | 0.85 | |

FIG. 14

Distance from nozzle end (5.14", 6.39", 7.64")

600

601

Degree disposal about the liner

| | 1st col. | 2nd col. | 3rd col. |
|---|---|---|---|
| degree | 5.14" | 6.39" | 7.64" |
| 0 | 0.912 | | 0.784 |
| 20 | | 0.85 | |
| 30 | 0.912 | | 0.784 |
| 40 | | 0.85 | |
| 60 | 0.912 | | 0.784 |
| 80 | | 0.85 | |
| 90 | 0.912 | | 0.784 |
| 100 | | 0.85 | |
| 120 | 0.912 | | 0.784 |
| 140 | | 0.85 | |
| 150 | 0.912 | | 0.784 |
| 160 | | 0.85 | |
| 180 | 0.912 | | 0.784 |
| 200 | | 0.85 | |
| 210 | 0.912 | | 0.784 |
| 220 | | 0.85 | |
| 240 | 0.912 | | 0.784 |
| 260 | | 0.85 | |
| 270 | 0.912 | | 0.784 |
| 280 | | 0.85 | |
| 300 | 0.912 | | 0.784 |
| 320 | | 0.85 | |
| 330 | 0.912 | | 0.784 |
| 340 | | 0.85 | |

FIG. 15

Distance from nozzle end (5.14", 6.39", 7.64")

700

701

Degree disposal about the liner

| | 1st col. | 2nd col. | 3rd col. |
|---|---|---|---|
| degree | 5.14" | 6.39" | 7.64" |
| 0 | 0.85 | | 0.85 |
| 20 | | 0.85 | |
| 30 | 0.85 | | 0.85 |
| 40 | | 0.85 | |
| 60 | 0.85 | | 0.85 |
| 80 | | 0.85 | |
| 90 | 0.85 | | 0.85 |
| 100 | | 0.85 | |
| 120 | 0.85 | | 0.85 |
| 140 | | 0.85 | |
| 150 | 0.85 | | 0.85 |
| 160 | | 0.85 | |
| 180 | 0.85 | | 0.85 |
| 200 | | 0.85 | |
| 210 | 0.85 | | 0.85 |
| 220 | | 0.85 | |
| 240 | 0.85 | | 0.85 |
| 260 | | 0.85 | |
| 270 | 0.85 | | 0.85 |
| 280 | | 0.85 | |
| 300 | 0.85 | | 0.85 |
| 320 | | 0.85 | |
| 330 | 0.85 | | 0.85 |
| 340 | | 0.85 | |

FIG. 17

Distance from nozzle end (5.14", 6.39", 7.64")

800

801

Degree disposal about the liner

| | 1st col. | 2nd col. | 3rd col. |
|---|---|---|---|
| degree | 5.14" | 6.39" | 7.64" |
| 0 | 0.784 | | 0.784 |
| 20 | | 0.85 | |
| 30 | 0.912 | | 0.912 |
| 40 | | 0.85 | |
| 60 | 0.784 | | 0.784 |
| 80 | | 0.85 | |
| 90 | 0.912 | | 0.912 |
| 100 | | 0.85 | |
| 120 | 0.784 | | 0.784 |
| 140 | | 0.85 | |
| 150 | 0.912 | | 0.912 |
| 160 | | 0.85 | |
| 180 | 0.784 | | 0.784 |
| 200 | | 0.85 | |
| 210 | 0.912 | | 0.912 |
| 220 | | 0.85 | |
| 240 | 0.784 | | 0.784 |
| 260 | | 0.85 | |
| 270 | 0.912 | | 0.912 |
| 280 | | 0.85 | |
| 300 | 0.784 | | 0.784 |
| 320 | | 0.85 | |
| 330 | 0.912 | | 0.912 |
| 340 | | 0.85 | |

FIG. 18

Distance from nozzle end (4.75", 6.39", 8.15")

900

901

Degree disposal about the liner

| degree | 1st col. 4.75" | 2nd col. 6.39" | 3rd col. 8.15" |
|---|---|---|---|
| 0 | 0.784 | | 0.784 |
| 20 | | 0.85 | |
| 30 | 0.912 | | 0.912 |
| 40 | | 0.85 | |
| 60 | 0.784 | | 0.784 |
| 80 | | 0.85 | |
| 90 | 0.912 | | 0.912 |
| 100 | | 0.85 | |
| 120 | 0.784 | | 0.784 |
| 140 | | 0.85 | |
| 150 | 0.912 | | 0.912 |
| 160 | | 0.85 | |
| 180 | 0.784 | | 0.784 |
| 200 | | 0.85 | |
| 210 | 0.912 | | 0.912 |
| 220 | | 0.85 | |
| 240 | 0.784 | | 0.784 |
| 260 | | 0.85 | |
| 270 | 0.912 | | 0.912 |
| 280 | | 0.85 | |
| 300 | 0.784 | | 0.784 |
| 320 | | 0.85 | |
| 330 | 0.912 | | 0.912 |
| 340 | | 0.85 | |

MIXING HOLE ARRANGEMENT AND METHOD FOR IMPROVING HOMOGENEITY OF AN AIR AND FUEL MIXTURE IN A COMBUSTOR

FIELD OF THE INVENTION

The disclosure relates generally to a mixing hole arrangement and method for improving homogeneity of an air fuel mixture in a combustor, and more particularly to a mixing hole arrangement and method for improving homogeneity of an air fuel mixture in a combustor via an impeding of a fluid flow into a mixing zone.

BACKGROUND OF THE INVENTION

Gas turbines comprise a compressor for compressing air, a combustor for producing a hot gas by burning fuel in the presence of the compressed air produced by the compressor, and a turbine to extract work from the expanding hot gas produced by the combustor. Gas turbines are known to emit undesirable oxides of nitrogen (NOx) and carbon monoxide (CO). Existing dry low NOx combustors (DLN combustors) minimize the generation of NOx, carbon monoxide, and other pollutants. These DLN combustors accommodate fuel-lean mixtures while avoiding the existence of unstable flames and the possibility of flame blowouts by allowing a portion of flame-zone air to mix with the fuel at lower loads. However, NOx emissions requirements are becoming more stringent, and therefore, the art is need of a lower NOx emission combustor.

SUMMARY

Disclosed is a mixing hole arrangement for improving homogeneity of an air and fuel mixture in a combustor, the mixing hole arrangement comprising a plurality of mixing holes defined by a liner, wherein at least one of the plurality of mixing holes is a mixing hole that is at least one of sized and positioned to impede penetration of a fluid flow into a primary mixing zone located in a head end of the combustor.

Also disclosed is a method for improving homogeneity of an air and fuel mixture in a combustor, the method comprising impeding penetration of a fluid flow into at least one of a fuel flow and a primary mixing zone of the combustor.

Further disclosed is a method for improving homogeneity of an air and fuel mixture in a combustor, the method comprising impeding penetration of a fluid flow from at least one of a plurality of mixing holes into a fuel flow and a primary mixing zone of a head end of the combustor, wherein said plurality of mixing holes are defined by a liner included in the combustor and the impeding is accomplished by sizing the plurality of mixing holes to include a predetermined hole diameter, and disposing said plurality mixing holes along said liner in at least one of a predetermined position and a predetermined number.

BRIEF DESCRIPTION OF THE DRAWINGS

The foregoing and other features and advantages of the present invention should be more fully understood from the following detailed description of illustrative embodiments taken in conjunction with the accompanying Figures in which like elements are numbered alike in the several Figures.

FIG. 10 is a table representing a mixing hole arrangement 200 in a head end portion of a liner of a combustor;

FIG. 11 is a table representing a mixing hole arrangement 300 in a head end portion of a liner of a combustor;

FIG. 12 is a table representing a mixing hole arrangement 400 in a head end portion of a liner of a combustor;

FIG. 13 is a table representing a mixing hole arrangement 500 in a head end portion of a liner of a combustor;

FIG. 14 is a table representing a mixing hole arrangement 600 in a head end portion of a liner of a combustor;

FIG. 15 is a table representing a mixing hole arrangement 700 in a head end portion of a liner of a combustor;

FIG. 17 is a table representing a mixing hole arrangement 800 in a head end portion of a liner of a combustor;

FIG. 18 is a table representing a mixing hole arrangement 900 in a head end portion of a liner of a combustor.

DETAILED DESCRIPTION OF THE INVENTION

Figure 1:
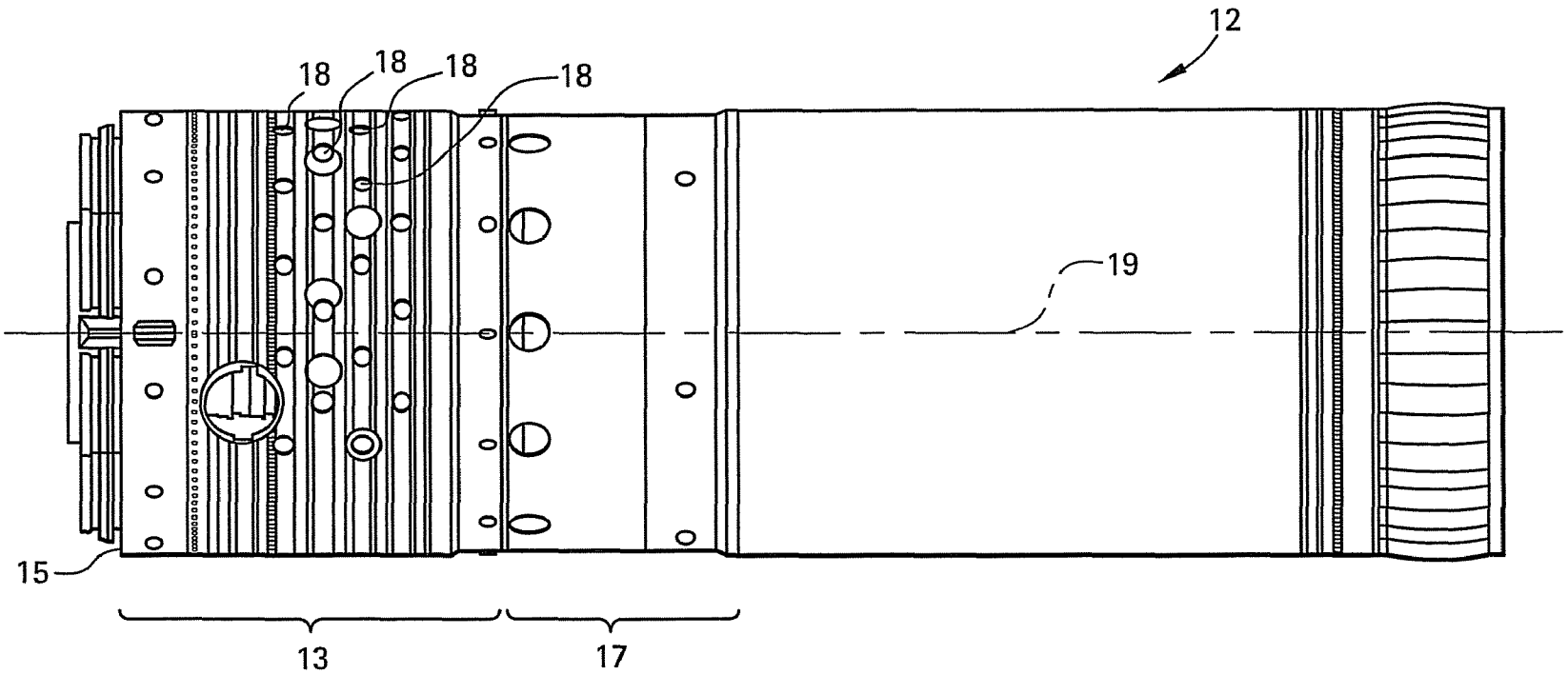
FIG. 1 is side view of a liner of a combustor.
Figure 2:
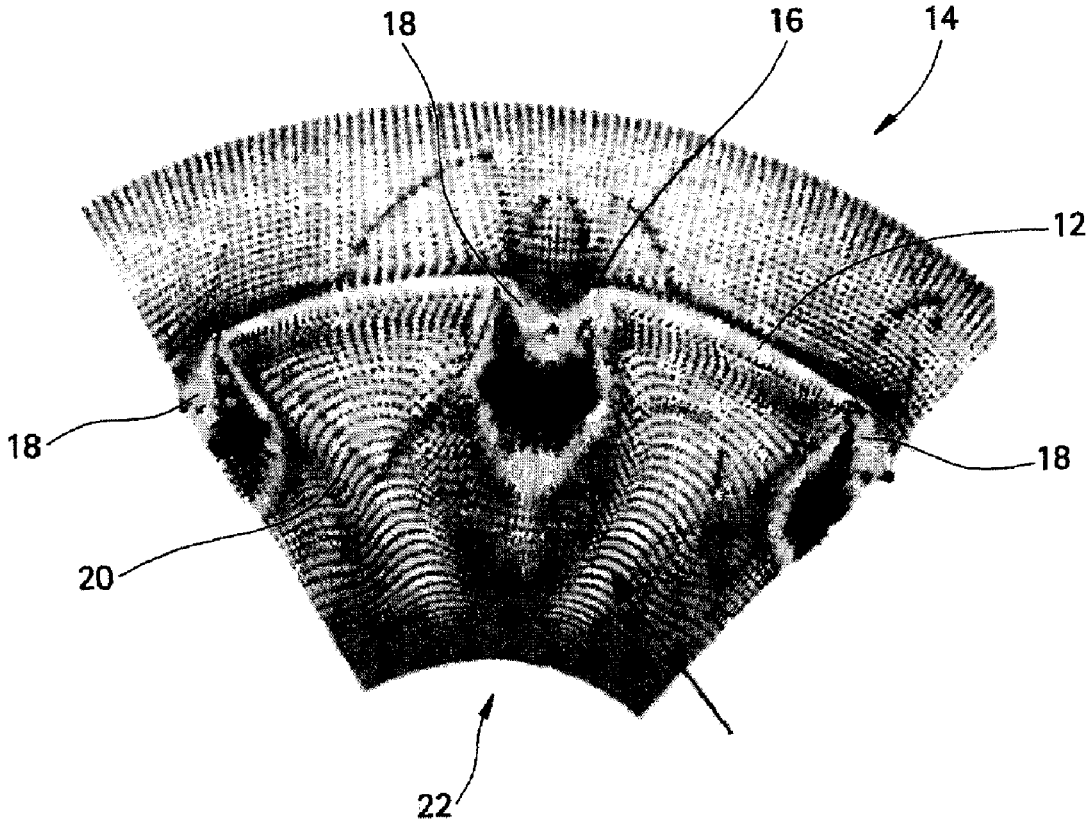
FIG. 2 is a transverse partial section of the combustor of FIG. 1.

Referring to FIGS. 1 and 2, a liner 12 including a head end 13 of a dry low NOx combustor 14 (shown partially in FIG. 2, but without a flow sleeve 16 that is shown in FIG. 1) is illustrated. The combustor 14 includes a primary nozzle end 15 and a venturi throat 17, between which the head end 13 is disposed. The liner 12 included in this head end 13 of the combustor 14 defines a plurality of mixing holes 18 disposed circumferentially around the liner 12. Hole spacing is measured in angles (i.e. 24 degrees between two holes 18) relative to a longitudinal central axis 19 of the combustor 14. The holes 18 allow air flowing through the flow sleeve 16 to penetrate into a primary mixing zone 20, through which the longitudinal central axis 19 runs. Once in the primary mixing zone 20, the air mixes with fuel to facilitate combustion. As shown in FIG. 2, the primary mixing zone 20 is disposed within the combustor 14, radially between the liner 12 and a center-body tube 22 and axially between the primary nozzle end 15 and the venturi throat 17.

Figure 3:
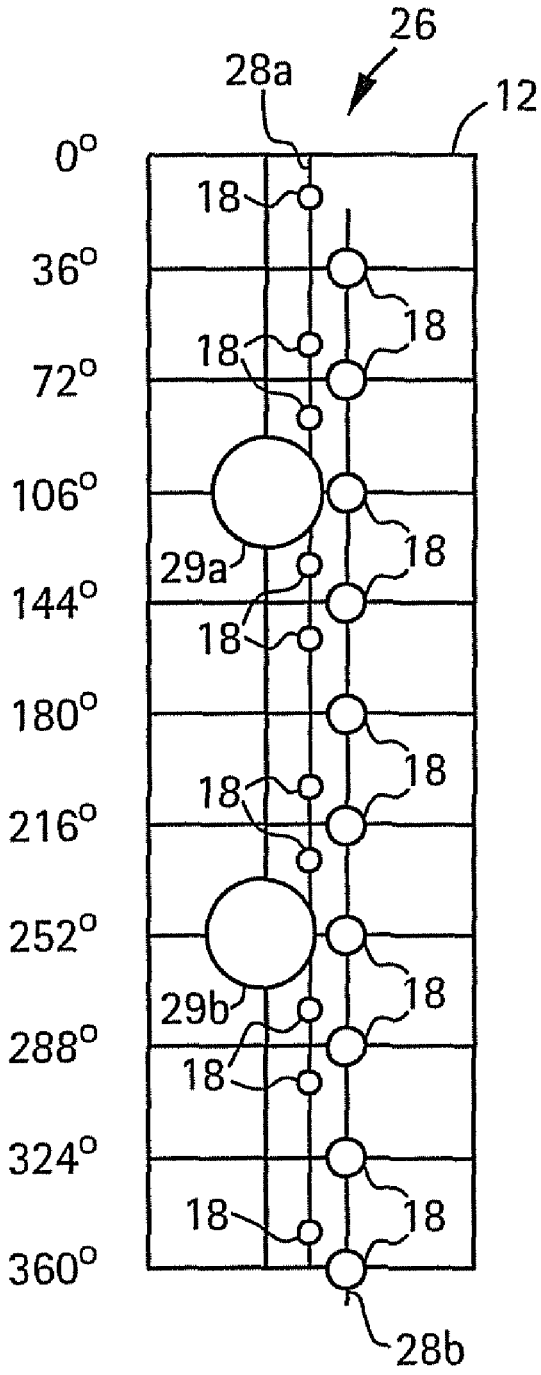
FIG. 3 is a schematic view of liner of a 35 megawatt combustor that is illustrated substantially flatly.

The liner 12 referred to above can be found in combustors producing varying amounts of power. Referring to FIG. 3, the liner 12 for the combustor 14 of a 35 megawatt combustion turbine is illustrated (the illustration is flat, though in application the mixing holes 18 are disposed radially about the liner 12, which is in a cylindrical construction), and includes an arrangement 26 of mixing holes 18 sized and positioned for allowing airflow into the primary mixing zone 20. These mixing holes 18 are disposed in two rows (a first row 28*a* and a second row 28*b*) of ten mixing holes 18 each. The first row 28*a* is typically located 4.9 inches from the primary nozzle end 15 shown in FIG. 1, and includes mixing holes 18 that are 0.77 inches in diameter and alternatingly positioned at distances of 24 and 48 degrees from each other around the cylindrical liner 12 (i.e. the mixing holes 18 are positioned in a pattern of 24-48-24-48 degrees from each other around the liner 12). The second row 28*b* is located 6.15 inches from the primary nozzle end 15, and includes mixing holes 18 that are 1.04 inches in diameter and positioned at distances of 36 degrees from each other around the liner 12. Two cross-fire tubes 29*a-b* are also illustrated between the first row 28*a* and the primary nozzle end 15.

Figure 4:
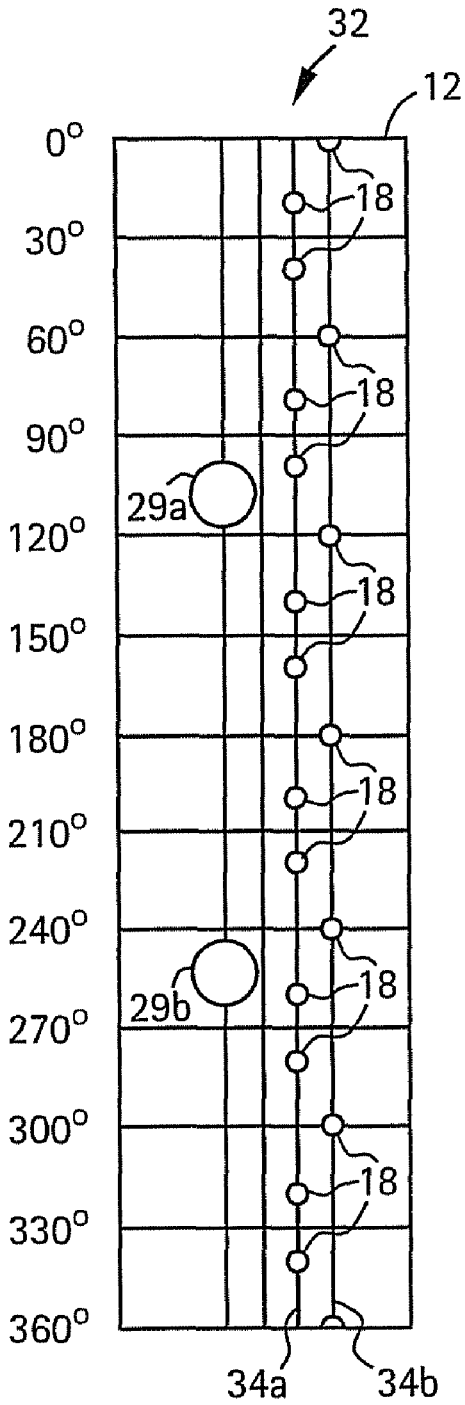
FIG. 4 is a schematic view of a liner of an 80 megawatt combustor that is illustrated substantially flatly.

Referring to FIG. 4, the liner 12 for the combustor 14 of an 80 megawatt combustion turbine is illustrated (the illustration is flat, though in application the mixing holes 18 are disposed circumferentially about the liner 12, which is in a cylindrical construction) and includes an arrangement 32 of mixing holes 18 sized and positioned for allowing airflow into the primary mixing zone 20. These mixing holes 18 are disposed in two rows (a first row 34*a* and a second row 34*b*) of twelve (34*a*) and six (34*b*) mixing holes 18, respectively. The first row 34*a* is located 6.39 inches from the primary nozzle end 15 shown in FIG. 1, and includes mixing holes 18 of that are 1.125 inches in diameter and alternatingly positioned at distances of 20 and 40 degrees from each other around the cylindrical liner 12 (i.e. the mixing holes 18 are positioned in a pattern of 20-40-20-40 degrees from each other around the liner 12). The second row 34*b* is located 7.64 inches from the primary nozzle end 15, and also includes mixing holes 18 that are 1.125 inches in diameter. However, the mixing holes 18 in the second row 34*b* are positioned consistently at distances of 60 degrees from each other around the liner 12. Two cross-fire tubes 29*a-b* like those mentioned above are additionally illustrated at the left of the first row 34*a*.

Figure 5:
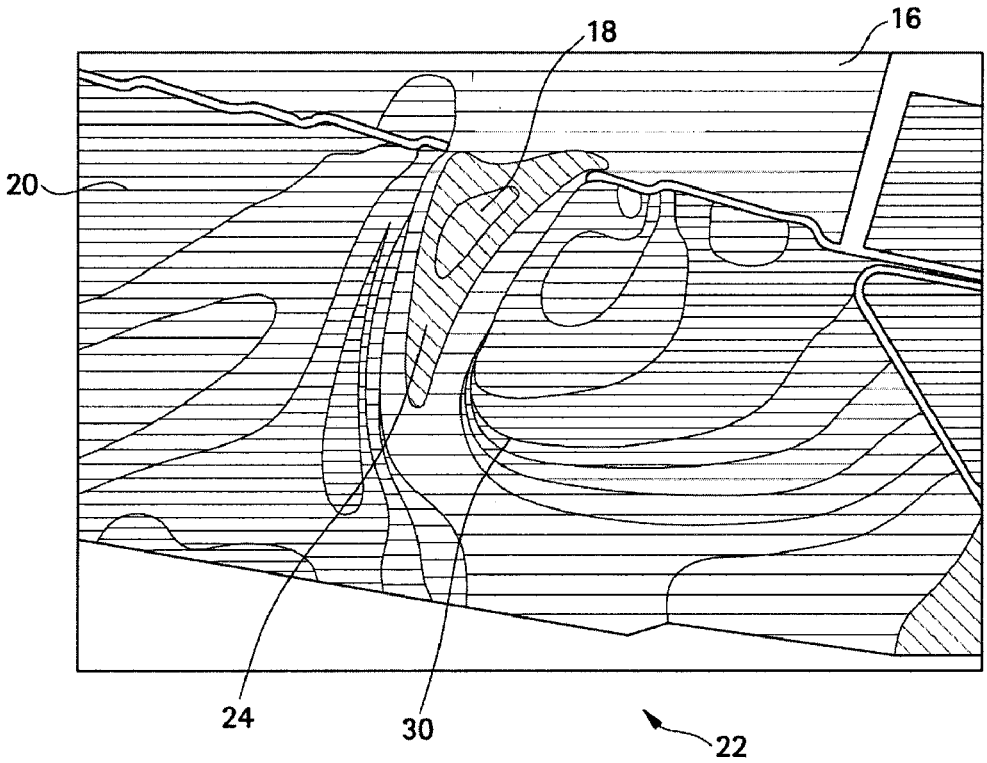
FIG. 5 is a representation of flow pattern into a primary mixing chamber.
Figure 6:
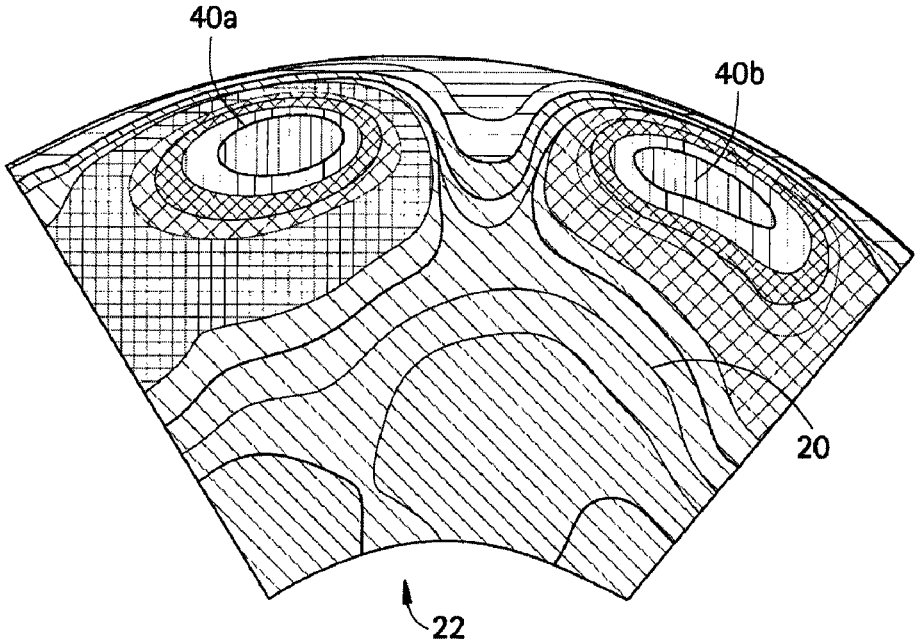
FIG. 6 is representation of a fuel concentration in the primary mixing chamber.

Mixing hole 18 arrangements like arrangements 26 and 32 typically result in a fluid flow 24 (which may be air) from the flow sleeve 16, through the mixing holes 18, and radially into the primary mixing zone 20, as shown in FIG. 5. The fluid flow 24 enters the primary mixing zone 20 roughly orthogonally to a direction of a fuel flow 30 introduced into the mixing zone 20. Because of a velocity of fluid flow 24, that flow 24 penetrates the fuel flow 30 to a depth sufficient to impact the center-body tube 22. Due to the impact of the fluid flow 24 against the center-body 22, this fluid flow 24 "splashes" off of the center-body tube 22, resulting in a pocketed, heterogeneous air and fuel mixture 38 like that which is shown in FIG. 6. In FIG. 6, the darker regions represent pockets of fuel 40*a-b* that have been pushed away from the center-body tube 22 by the splashing fluid flow 24.

Figure 7:
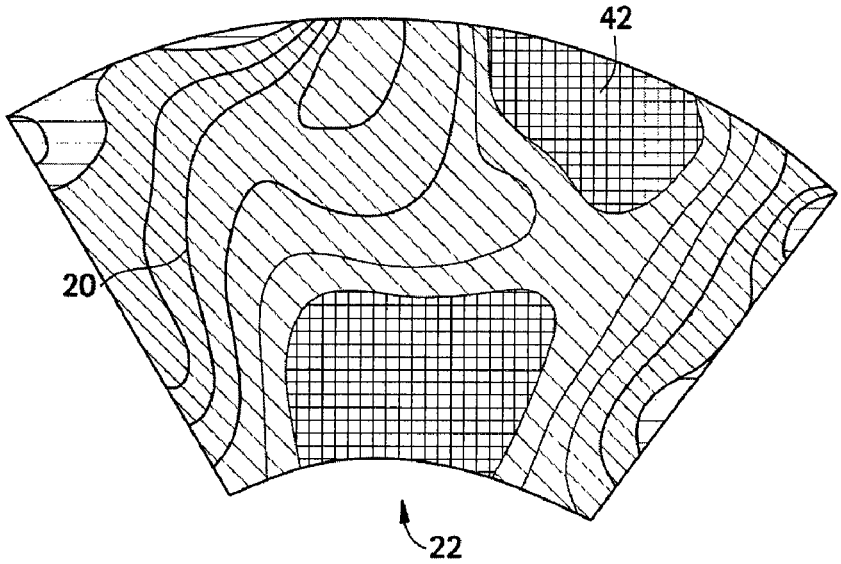
FIG. 7 is a representation of fuel concentration in the primary mixing chamber according to one aspect of the invention.
Figure 8:
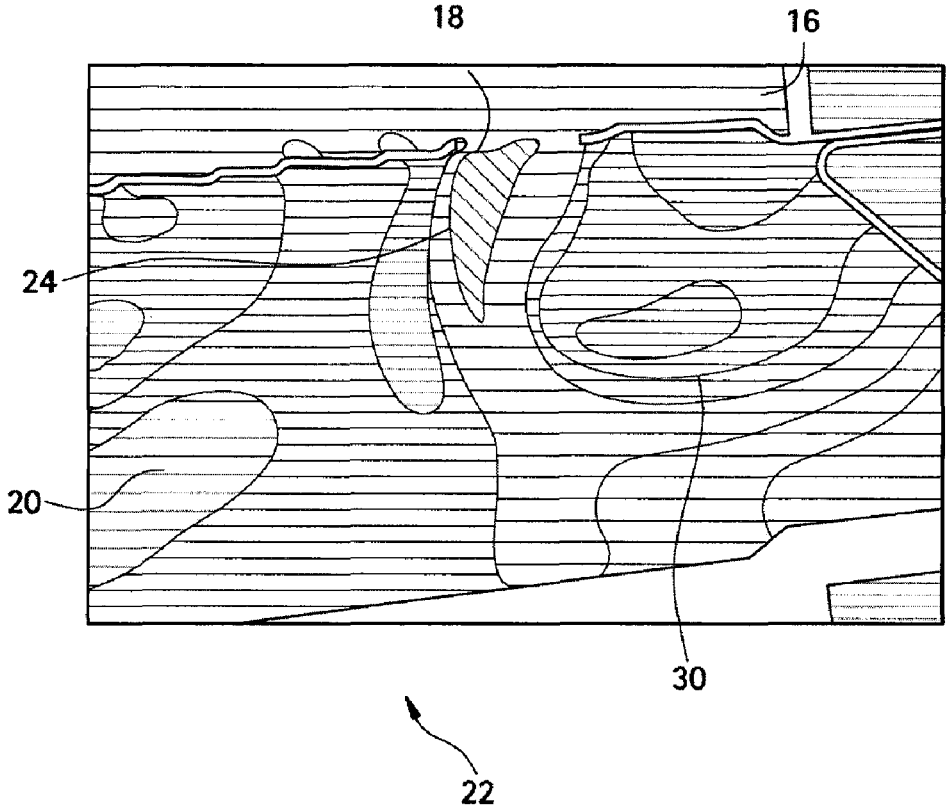
FIG. 8 is a representation of flow pattern into the primary mixing chamber according to one aspect of the invention.

Referring now to FIG. 7, a less heterogeneous air and fuel mixture 42 is illustrated. In FIG. 7, fuel pocketing has been reduced as compared with the fuel pocketing of FIG. 6. This less heterogeneous mixture 42 achieves improved NOx emissions in combustors such as dry low NOx combustors, like the one partially illustrated in of FIGS. 1 and 2. This homogeneity can be achieved by impeding penetration of the fluid flow 24 into the primary mixing zone 20 during combustor operation, as shown in FIG. 8. In FIG. 8, penetration of the fluid flow 24 into the fuel flow 30 is reduced (impeded) compared with the mixing of FIG. 5 (which results from hole arrangements 26 and 32) reducing splash of the fluid flow 24 off the center-body tube 22. Penetration of the fluid flow 24 into the primary mixing zone 20 can be represented as a percentage of the distance between the liner 12 and the centerbody 22. Anything over 100% would be a condition where the fluid flow splashes off the centerbody with 200% representing a much stronger splash than, for example 125%. The penetration is calculated using standard correlations for a jet (fluid flow 24) penetrating into crossflow, a standard correlation being $Y_{max}/D_j$=sqrt(Momentum of Jet/Momentum of crossflow)*$C_1$ (where $Y_{max}$=Max jet penetration, $D_j$=Jet diameter, Momentum of Jet=$0.5*\rho_j*V_j^2$, Momentum of Crossflow=$0.5*\rho_{cf}*V_{cf}^2$, $C_1$=1.15 for these calculations, $\rho_j$=Density of jet fluid, $\rho_{cf}$=Density of cross-flow fluid, $V_j$=Jet Velocity, and $V_{cf}$=Cross flow velocity). Fluid flow 24 penetrating about 195% or more into the primary mixing zone 20 can lead to a heterogeneous air-fuel mixture that creates undesirably high emissions. In FIG. 8, the fluid flow 24 penetrates less than or equal to about 165% into the primary mixing zone 20, with an exemplary range of between about 100% and 165%. The exemplary range optimizes a balance between decreasing emissions and maintaining stability.

Figure 9:
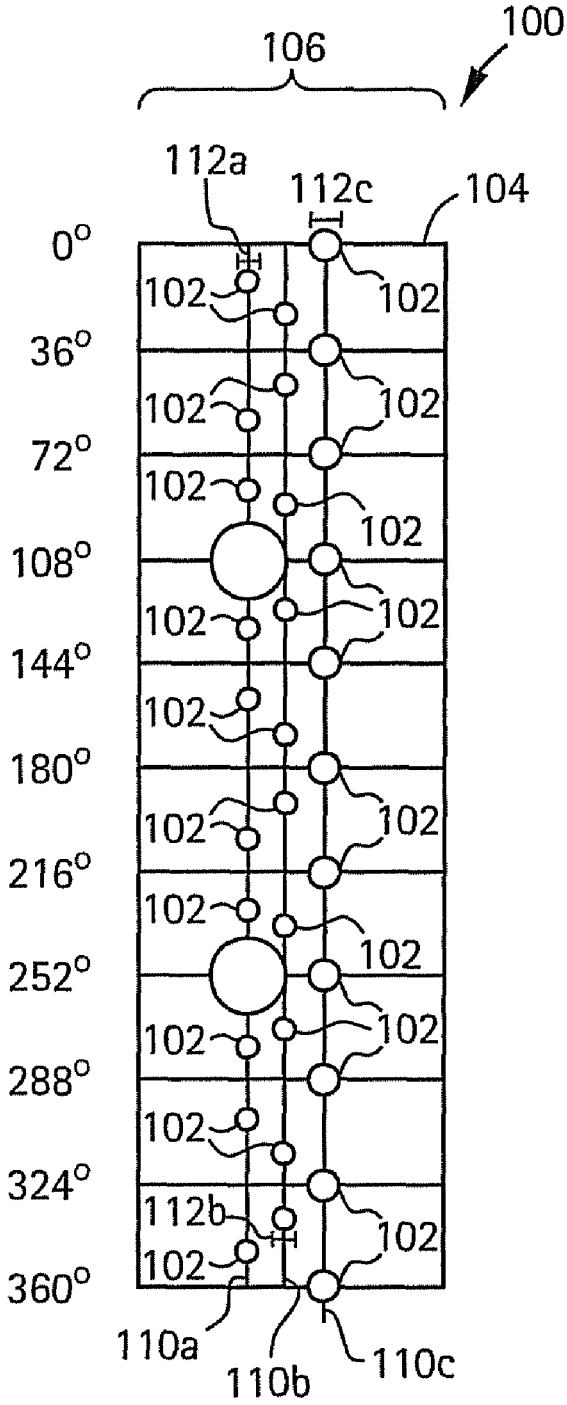
FIG. 9 is a schematic view of a head end portion of a liner of a combustor that is illustrated substantially flatly and in accordance with an exemplary embodiment of a mixing hole arrangement 100.

Referring to FIG. 9, an exemplary embodiment of a mixing hole arrangement 100 that will allow for the improved less heterogeneous air and fuel mixture 42 shown in FIG. 7 is illustrated. This arrangement 100 impedes penetration of the fluid flow 24 into the fuel flow 30 and primary mixing zone 20, allowing for the less heterogeneous mixture 42. Impeding the fluid flow 24, as shown in FIG. 8, via this arrangement 100 causes the fluid flow 24 to penetrate less than or equal to about 165% into the primary mixing zone 20, with the exemplary range of between about 150% and 165%, as was mentioned above. The arrangement 100 comprises a plurality of mixing holes 102 defined by a liner 104 (the illustration is flat, though in application the mixing holes 102 are disposed radially about the liner 104, which is cylindrical in construction) of the head end 106. At least one of this plurality of mixing holes 102 is at least on of sized (diameter) and positioned to impede penetration of the fluid flow 24 into the primary mixing zone 20 shown in FIG. 8.

The combustor 14 in this embodiment is a dry low NOx combustor (like that which is shown in FIG. 1), which may be for a 35 megawatt variety turbine. The mixing holes 102 are arranged in three rows, illustrated as a first row 110*a*, a second row 110*b*, and a third row 110*c*. The mixing holes 102 in at least one of the three rows are sized (diameter) and positioned to impede penetration of the fluid flow 24 into the fuel flow 30 and primary mixing zone 20. In the exemplary embodiment, the mixing holes 102 in the first row 110*a* are positioned to include alternating distances of 24 and 36 degrees between each mixing hole 102 around the liner 104 (i.e. the mixing holes 102 are at 24 degrees, 60 degrees, 84 degrees, 120 degrees, and so on around the liner 104), at a distance of 3.65 inches from the primary nozzle end 15 (illustrated in FIG. 1). These mixing holes 102 also have a diameter 112*a* of 0.59 inches. The mixing holes 102 in the second row 10*b* (in the exemplary embodiment) are positioned at 102 at 12, 60, 90, 126, 168, 192, 234, 270, 312, and 348 degrees around the liner 104, at a distance of 4.9 inches from the primary nozzle end 15. These mixing holes 102 have a diameter 112*b* of 0.71 inches. The mixing holes 102 in the third row 110*c* (also in the exemplary embodiment) are positioned 36 degrees from each other around the liner 104, at a distance of 6.15 inches from the primary nozzle end 15. These mixing holes 102 have a diameter 112*c* of 0.98 inches.

Three rows, the overall decrease in diameter 112*a-c* of the mixing holes 102, and the positioning of the mixing holes 102 are all elements of the arrangement 100 that may impede fluid flow 24 penetration as shown in FIG. 8, and result in the less heterogeneous mixture 42 shown in FIG. 7. It should be appreciated that though these three rows 110*a-c* each include the same number of mixing holes 102 (ten), each individual row may include more or less mixing holes 102. It should also be appreciated that the arrangement 100 is intended to increase homogeneity, but may not be intended to maximize homogeneity of a fluid and fuel mixture. A mixture that is too homogeneous will decrease stability along with decreasing NOx emissions. The arrangement 100 decreases emissions while maintaining a balance between emissions and stability. Striking this balance (i.e. to making a mixture too homogeneous) is one reason why only some of the plurality of mixing holes 102 might be sized and positioned to impede fluid flow 24 penetration into the primary mixing zone 20.

Referring to FIG. 10, an exemplary embodiment of a mixing hole arrangement 200 that will allow for the improved less heterogeneous air and fuel mixture 42 shown in FIG. 7 is illustrated. FIG. 10 illustrates a table 201 that represents positioning of the mixing hole arrangement 200 in a liner like liner 104 of FIG. 9. This arrangement 200 impedes penetration of the fluid flow 24 into the fuel flow 30 and primary mixing zone 20, allowing for the homogeneous mixture 42. The arrangement 200 comprises a plurality of mixing holes represented in the table 201 by a measure of diameter disposed in an appropriate row and column. At least one of this plurality of mixing holes in arrangement 200 is at least one of sized (diameter) and positioned to impede fluid flow 24 penetration into the primary mixing zone 20 shown in FIG. 8.

The combustor 14 in this embodiment is a dry low NOx combustor (like that which is shown in FIG. 1), which may be for a 35 megawatt turbine. The mixing holes of arrangement 200 are arranged in three rows, illustrated in table 201 as a first column, a second column, and a third column. The mixing holes in at least one of the three rows are sized (diameter) and positioned to impede penetration of the fluid flow 24 into the fuel flow 30 and primary mixing zone 20. In this embodiment, mixing hole diameter decreases as the rows move away from the primary nozzle end 15 (FIG. 1), as opposed to increasing as shown in FIG. 9. The mixing holes of the arrangement 200 that are disposed in the third row (represented in the third column of the table 201) are positioned to include alternating distances of 24, 36, and 48 degrees between each mixing hole around the circular liner (i.e. the mixing holes 102 are at 24 degrees, 48 degrees, 84 degrees, 132 degrees, 156 degrees and so on around the liner 104), at a distance of 6.15 inches from the primary nozzle end 15 (which is shown in FIG. 1). These mixing holes also have a diameter of 0.59 inches. The mixing holes of the arrangement 200 in the second row (represented in the second column of the table 201) are positioned at 12, 60, 90, 126, 168, 192, 234, 270, 312, and 348 degrees around the liner, at a distance of 4.9 inches from the primary nozzle end 15. These mixing holes have a diameter of 0.71 inches. The mixing holes of the arrangement 200 in the first row (represented in the third column of the table 201) are positioned 36 degrees from each other around the liner, at a distance of 3.65 inches from the primary nozzle end 15 (as shown in FIG. 1). These mixing holes have a diameter of 0.98 inches.

Three rows, the overall decrease in diameter of the mixing holes, and the positioning of the mixing holes are all elements of the arrangement 200 that may impede fluid flow 24 penetration to various levels in the primary mixing zone 20, and result in the less heterogeneous mixture 42 shown in FIG. 7. Impeding the fluid flow 24 via this arrangement 200 causes the fluid flow 24 to penetrate variously depending on whether the flow is from the holes in the first row second row or third row. Fluid flow 24 from the first row has maximum penetration and penetrates more than or equal to about 250% into the primary mixing zone 20 with an exemplary range between about 250% and 280%. Fluid flow from the second row penetrates less than or equal to about 175% into the primary mixing zone 20, with an exemplary range of between about 130% and 175%, whereas the third row penetrates less than or equal to about 100% into the primary mixing zone 20, with an exemplary range of between about 80% and 100%. It should be appreciated that though the three rows of the arrangement 200 each include the same number of mixing holes (ten), each individual row may include more or less mixing holes. It should also be appreciated that the arrangement 200 is intended to increase homogeneity, but may not be intended to maximize homogeneity of a fluid and fuel mixture. A mixture that is too homogeneous will decrease stability along with decreasing NOx emissions. The arrangement 200 decreases emissions while maintaining a balance between emissions and stability. Striking this balance (i.e. to making a mixture too homogeneous) is one reason why only some of the plurality of mixing holes might be sized and positioned to impede fluid flow 24 penetration into the primary mixing zone 20.

Referring to FIG. 11, an exemplary embodiment of a mixing hole arrangement 300 that will allow for the improved less heterogeneous air and fuel mixture 42 shown in FIG. 7 is illustrated. FIG. 11 illustrates a table 301 that represents positioning of the mixing hole arrangement 300 in a liner like liner 104 of FIG. 9. The arrangement 300 comprises a plurality of mixing holes represented in the table 301 by a measure of diameter disposed in an appropriate row and column. At least one of the plurality of mixing holes of the arrangement 300 is at least one of sized (diameter) and positioned to impede fluid flow 24 penetration into the primary mixing zone 20 shown in FIG. 8.

The combustor 14 in this embodiment is a dry low NOx combustor (like that which is shown in FIG. 1), which may be for a 35 megawatt turbine. The mixing holes are arranged in three rows, illustrated in table 301 as a first column, a second column, and a third column. The mixing holes in the three rows are sized to impede penetration of the fluid flow 24 into the fuel flow 30 and primary mixing zone 20, with the first column and the second column illustrating rows that are positioned to impede airflow penetration and allow for a less heterogeneous air and fuel mixture 42 (FIG. 7). In this embodiment, mixing hole diameter remains constant throughout all three rows, with each of the mixing holes of the arrangement 300 having a diameter of 0.777 inches. The mixing holes in the first row (represented in the first column of the table 301) are positioned at 24, 48, 84, 132, 156, 204, 228, 276, 300, and 336 degrees, at a distance of 3.65 inches from the primary nozzle end 15 (as shown in FIG. 1). The mixing holes in the second row (represented in the second column of the table 301) are positioned at 12, 60, 90, 126, 168, 192, 234, 270, 312, and 348 degrees around the circular liner, at a distance of 4.9 inches from the primary nozzle end 15. The mixing holes 302 in the third row (represented in the third column of the table 301) are positioned 36 degrees from each other around the liner, at a distance of 6.15 inches from the primary nozzle end 15.

Three rows, the overall decrease in diameter of the mixing holes in the arrangement 300, and the positioning of the mixing holes are all elements of the arrangement 300 that may impede fluid flow 24 penetration, and result in the less heterogeneous mixture 42 shown in FIG. 7. Impeding the fluid flow 24 via this arrangement 300 causes the fluid flow 24 from the first row to penetrate more than or equal to about 200% into the primary mixing zone 20 with an exemplary range of between about 200% and 220%, fluid flow 24 from the second row to penetrate less than or equal to about 165% into primary mixing zone 20 with an exemplary range of between about 150% and 165% and fluid flow 24 from the third row to penetrate less than or equal to about 130% into the primary mixing zone 20, with an exemplary range of between about 115% and 130% It should be appreciated that though these three rows each include the same number of mixing holes (ten), each individual row may include more or less mixing holes. It should also be appreciated that the arrangement 300 is intended to increase homogeneity, but may not be intended to maximize homogeneity of a fluid and fuel mixture. A mixture that is too homogeneous will decrease stability along with decreasing NOx emissions. The arrangement 300 decreases emissions while maintaining a balance between emissions and stability. Striking this balance (i.e. to making a mixture too homogeneous) is one reason why only some of the plurality of mixing holes might be sized and positioned to impede fluid flow 24 penetration into the primary mixing zone 20.

Referring to FIG. 12, an exemplary embodiment of a mixing hole arrangement 400 that will allow for the improved less heterogeneous air and fuel mixture 42 shown in FIG. 7 is illustrated. FIG. 12 illustrates a table 401 that represents positioning of the mixing hole arrangement 400 in a liner like liner 104 of FIG. 9. The arrangement 400 comprises a plurality of mixing holes represented in the table 401 by a measure of diameter disposed in an appropriate row and column. At least one of the plurality of mixing holes of the arrangement 400 is at least one of sized (diameter) and positioned to impede airflow penetration into the primary mixing zone 20 shown in FIG. 8.

The combustor 14 in this embodiment is a dry low NOx combustor (like that which is shown in FIG. 1), which may be for a 35 megawatt turbine. The mixing holes are arranged in three rows, illustrated in table 401 as a first column, a second column, and a third column. The mixing holes of the arrangement 400 that are in the first row and second row (represented in the first column and second column respectively of the table 401) of this embodiment 400 are sized to impede penetration of the fluid flow 24 into the fuel flow 30 and primary mixing zone 20, while only some of the mixing holes in the third row (represented in the third column of the table 401) are necessarily sized to impede penetration of the fluid flow 24 into the fuel flow 30 and primary mixing zone 20. This is the case because in this embodiment, the mixing holes within the third row are themselves of varying sizes, and some may not be of a size that will impede penetration. As to positioning in this embodiment, the first row and the second row are positioned to impede airflow penetration and allow for a less heterogeneous air and fuel mixture 42 (FIG. 7). The mixing holes in the first row are positioned at 24, 48, 84, 132, 156, 204, 228, 276, 300, and 336 degrees around the liner, at a distance of 3.65 inches from the primary nozzle end 15 (as shown in FIG. 1). These mixing holes have a diameter of 0.59 inches. The mixing holes in the second row are positioned at 12, 60, 90, 126, 168, 192, 234, 270, 312, and 348 degrees around the liner, at a distance of 4.9 inches from the primary nozzle end 15. These mixing holes have a diameter 412*b* of 0.71 inches. The mixing holes in the third row are 36 degrees from each other around the liner, at a distance of 3.65 inches from the primary nozzle end 15. These mixing holes alternate between having a diameter of 0.71 inches and a diameter of 1.39 inches in this embodiment.

Three rows, the overall decrease in diameter of the mixing holes of the arrangement 400, and the positioning of the mixing holes are all elements of the arrangement 400 that may impede fluid flow 24 penetration, and result in the less heterogeneous mixture 42 shown in FIG. 7. Impeding the fluid flow 24 via this arrangement 400 causes the fluid flow 24 to penetrate less than or equal to about 165% into the primary mixing zone 20, with an exemplary range of between about 150% and 165% for the first and second rows. Fluid flow 24 from the holes of the third row with a diameter of 0.71 penetrate less than or equal to about 120% into the primary mixing zone 20, with an exemplary range of between about 100% and 120%, while fluid flow 24 from holes of the third row with diameter of 1.39 inches penetrate more than or equal to about 200% into the primary mixing zone 20 with an exemplary range of between about 200% and 220%. It should be appreciated that though the three rows of the arrangement 400 each include the same number of mixing holes (ten), each individual row may include more or less mixing holes. It should also be appreciated that the arrangement 400 is intended to increase homogeneity, but may not be intended to maximize homogeneity of a fluid and fuel mixture. A mixture that is too homogeneous will decrease stability along with decreasing NOx emissions. The arrangement 400 decreases emissions while maintaining a balance between emissions and stability. Striking this balance (i.e. to making a mixture too homogeneous) is one reason why only some of the plurality of mixing holes 402 might be sized and positioned to impede fluid flow 24 penetration into the primary mixing zone 20. In this particular embodiment, the mixing holes in the third row having the diameters of 0.71 and 1.39 are differently sized to specifically cause local heterogeneity to maintain the balance between stability and emissions.

Referring to FIG. 13, an exemplary embodiment of a mixing hole arrangement 500 that will allow for the improved less heterogeneous air and fuel mixture 42 shown in FIG. 7 is illustrated. FIG. 13 illustrates a table 501 that represents positioning of the mixing hole arrangement 400 in a liner like liner 104 of FIG. 9. Impeding the fluid flow 24 via this arrangement 500 causes the fluid flow 24 to penetrate less than or equal to about 165% into the primary mixing zone 20, with an exemplary range of between about 150% and 165%, as was mentioned above and is illustrated in FIG. 8. The arrangement 500 comprises a plurality of mixing holes represented in the table 501 by a measure of diameter disposed in an appropriate row and column. At least one of the plurality of mixing holes in the arrangement 500 is at least one of sized (diameter) and positioned to impede airflow penetration into the primary mixing zone 20 shown in FIG. 8.

The combustor 14 in this embodiment is a dry low NOx combustor (like that which is shown in FIG. 1), which may be for an 80 megawatt turbine. The mixing holes of the arrangement 500 are arranged in three rows, illustrated in table 501 as a first column, a second column, and a third column. The mixing holes in at least one of the three rows are sized (diameter) and positioned to impede penetration of the fluid flow 24 into the fuel flow 30 and primary mixing zone 20. The mixing holes in the first row (represented in the first column of the table 501) are positioned 30 degrees from each other around the liner, at a distance of 5.14 inches from the primary nozzle end 15 (as shown in FIG. 1). These mixing holes have a diameter of 0.784 inches. The mixing holes in the second row (represented in the second column of the table 501) are positioned 30 degrees from each other around the liner, at a distance of 6.39 inches from the primary nozzle end 15. These mixing holes have a diameter of 0.85 inches. The mixing holes in the third row (represented in the third column of the table 501) are positioned 30 degrees from each other around the liner, at a distance of 7.64 inches from the primary nozzle end 15. These mixing holes 502 have a diameter of 0.912 inches.

Three rows, the overall decrease in diameter of the mixing holes of the arrangement 500, and the positioning of the mixing holes are all elements of the arrangement 500 that may impede fluid flow 24 penetration, and result in the less heterogeneous mixture 42 shown in FIG. 7. It should be appreciated that though these three rows each include the same number of mixing holes (twelve), each individual row may include more or less mixing holes. It should also be appreciated that the arrangement 500 is intended to increase homogeneity, but may not be intended to maximize homogeneity of a fluid and fuel mixture. A mixture that is too homogeneous will decrease stability along with decreasing NOx emissions. The arrangement 500 decreases emissions while maintaining a balance between emissions and stability. Striking this balance (i.e. to making a mixture too homogeneous) is one reason why only some of the plurality of mixing holes might be sized and positioned to impede fluid flow 24 penetration into the primary mixing zone 20.

Referring to FIG. 14, an exemplary embodiment of a mixing hole arrangement 600 that will allow for the improved less heterogeneous air and fuel mixture 42 shown in FIG. 7 is illustrated. FIG. 14 illustrates a table 601 that represents positioning of the mixing hole arrangement 600 in a liner like liner 104 of FIG. 9. The arrangement 600 comprises a plurality of mixing holes represented in the table 601 by a measure of diameter disposed in an appropriate row and column. At least one of the plurality of mixing holes of the arrangement 600 is at least one of sized (diameter) and positioned to impede fluid flow 24 penetration into the primary mixing zone 20 shown in FIG. 8.

The combustor 14 in this embodiment is a dry low NOx combustor (like that which is shown in FIG. 1), which may be for an 80 megawatt turbine. The mixing holes are arranged in three rows, illustrated in table 601 as a first column, a second column, and a third column. The mixing holes in at least one of the three rows are sized (diameter) and positioned to impede penetration of the fluid flow 24 into the fuel flow 30 and primary mixing zone 20. In this embodiment mixing hole diameter decreases as the rows move away from the primary nozzle end 15 (FIG. 1), as opposed to increasing as shown in FIG. 13. The mixing holes in the first row (represented in the first column of the table 601) are positioned 30 degrees from each other around the liner, at a distance of 5.14 inches from the primary nozzle end 15. These mixing holes have a diameter of 0.912 inches. The mixing holes in the second row (represented in the second column of the table 601) are positioned 30 degrees from each other around the liner, at a distance of 6.39 inches from the primary nozzle end 15. These mixing holes have a diameter of 0.85 inches. The mixing holes in the third row (represented in the third column of the table 601) are positioned 30 degrees from each other around the liner, at a distance of 7.64 inches from the primary nozzle end 15. These mixing holes 602 have a diameter of 0.784 inches.

Three rows, the overall decrease in diameter of the mixing holes in the arrangement 600, and the positioning of the mixing holes are all elements of the arrangement 600 that may impede fluid flow 24 penetration, and result in the less heterogeneous mixture 42 shown in FIG. 7. Impeding the fluid flow 24 via this arrangement 600 causes the fluid flow 24 to penetrate variously depending on whether the flow is from the holes in the first row second row or third row. Fluid flow 24 from the first row has maximum penetration and penetrates more than or equal to about 250% into the primary mixing zone 20 with and exemplary range between about 250% and 280%. Fluid flow from the second row penetrates less than or equal to about 175% into the primary mixing zone 20, with an exemplary range of between about 130% and 175%, whereas the third row penetrates less than or equal to about 100% into the primary mixing zone 20, with an exemplary range of between about 80% and 100%. It should be appreciated that though these three rows each include the same number of mixing holes (twelve), each individual row may include more or less mixing holes. It should also be appreciated that the arrangement 600 is intended to increase homogeneity, but may not be intended to maximize homogeneity of a fluid and fuel mixture. A mixture that is too homogeneous will decrease stability along with decreasing NOx emissions. The arrangement 600 decreases emissions while maintaining a balance between emissions and stability. Striking this balance (i.e. to making a mixture too homogeneous) is one reason why only some of the plurality of mixing holes might be sized and positioned to impede fluid flow 24 penetration into the primary mixing zone 20.

Referring to FIG. 15, an exemplary embodiment of a mixing hole arrangement 700 that will allow for the improved less heterogeneous air and fuel mixture 42 shown in FIG. 7 is illustrated. FIG. 15 illustrates a table 701 that represents positioning of the mixing hole arrangement 700 in a liner like liner 104 of FIG. 9. Impeding the fluid flow 24 via this arrangement 700 causes the fluid flow 24 to penetrate less than or equal to about 138% into the primary mixing zone 20, with an exemplary range of between about 110% and 138%, as was mentioned above and is illustrated in FIG. 8. The arrangement 700 comprises a plurality of mixing holes represented in the table 701 by a measure of diameter disposed in an appropriate row and column. At least one of this plurality of mixing holes in the arrangement 700 is at least one of sized (diameter) and positioned to impede fluid flow 24 penetration into the primary mixing zone 20 shown in FIG. 8.

The combustor 14 in this embodiment is a dry low NOx combustor (like that which is shown in FIG. 1), which may be for an 80 megawatt turbine. The mixing holes are arranged in three rows, illustrated in table 701 as a first column, a second column, and a third column. The mixing holes in at least one of the three rows are sized (diameter) and positioned to impede penetration of the fluid flow 24 into the fuel flow 30 and primary mixing zone 20. In this arrangement 700, size of the mixing holes remains constant throughout all three rows (respectfully represented in the first column, second column, and third column of the table 701), with each mixing hole having a diameter of 0.85 inches. The mixing holes in the first row (represented in the first column of the table 701) are positioned 30 degrees from each other around the liner, at a distance of 5.14 inches from the primary nozzle end 15 (as shown in FIG. 1). The mixing holes in the second row (represented in the second column of the table 701) are positioned 30 degrees from each other around the liner, at a distance of 6.39 inches from the primary nozzle end 15. The mixing holes in the third row (represented in the third column of the table 701) are positioned 30 degrees from each other around the liner, at a distance of 7.64 inches from the primary nozzle end 15.

Three rows, the overall decrease in diameter of the mixing holes in the arrangement, and the positioning of the mixing holes are all elements of the arrangement 700 that may impede fluid flow 24 penetration, and result in the less heterogeneous mixture 42 shown in FIG. 7. It should be appreciated that though these three rows each include the same number of mixing holes (twelve), each individual row may include more or less mixing holes. It should also be appreciated that the arrangement 700 is intended to increase homogeneity, but may not be intended to maximize homogeneity of a fluid and fuel mixture. A mixture that is too homogeneous will decrease stability along with decreasing NOx emissions. The arrangement 700 decreases emissions while maintaining a balance between emissions and stability. Striking this balance (i.e. to making a mixture too homogeneous) is one reason why only some of the plurality of mixing holes might be sized and positioned to impede fluid flow 24 penetration into the primary mixing zone 20.

Figure 16:
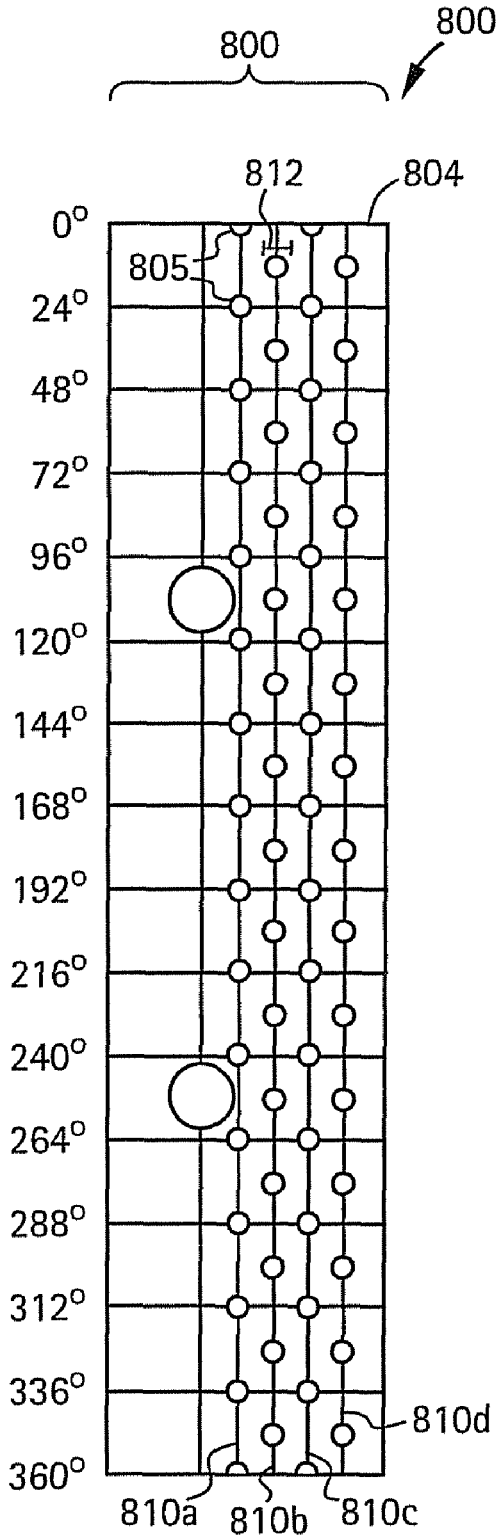
FIG. 16 is a schematic view of a head end portion of a liner from a combustor that is illustrated substantially flatly and in accordance with an exemplary embodiment of a mixing hole arrangement 800.

Referring to FIG. 16, an exemplary embodiment of a mixing hole arrangement 800 that will allow for the improved less heterogeneous air and fuel mixture 42 shown in FIG. 7 is illustrated. This arrangement 800 impedes penetration of the fluid flow 24 into the fuel flow 30 and primary mixing zone 20, allowing for the homogeneous mixture 42. Impeding the fluid flow 24 via this arrangement 800 causes the fluid flow 24 to penetrate less than or equal to about 110% into the primary mixing zone 20, with an exemplary range of between about 90% and 110%, as was mentioned above and is illustrated in FIG. 8. The arrangement 800 comprises a plurality of mixing holes 802 defined by a liner 804 (the illustration is flat, though in application the mixing holes 802 are disposed circumferentially about the liner 804, which is cylindrical in construction) of the head end 806. At least one of this plurality of mixing holes 802 is at least one of sized (diameter) and positioned to impede fluid flow penetration into the primary mixing zone 20 shown in FIG. 8.

The combustor 14 in this embodiment is a dry low NOx combustor (like that which is shown in FIG. 1), which may be for an 80 megawatt turbine. The mixing holes 802 are arranged in four rows, illustrated as a first row 810*a*, a second row 810*b*, a third row 810*c*, and a fourth row 810*d*. The mixing holes 802 in at least one of the four rows 810*a-d* are sized (diameter) and positioned to impede penetration of the fluid flow 24 into the fuel flow 30 and primary mixing zone 20. In this embodiment, mixing hole 802 size remains constant throughout all four rows 810*a-d*, with each mixing hole 802 having a diameter 812 of 0.655 inches. The mixing holes 802 in the first row 810*a* are positioned 24 degrees from each other around the liner 804, at a distance of 5.14 inches from the primary nozzle end 15 (as shown in FIG. 1). The mixing holes 802 in the second row 810*b* are positioned 24 degrees from each other around the liner 804, at a distance of 6.39 inches from the primary nozzle end 15. The mixing holes 802 in the third row 810*c* are positioned 24 degrees from each other around the liner 804, at a distance of 7.64 inches from the primary nozzle end 15. The mixing holes 802 in the fourth row 810*d* are positioned 24 degrees from each other around the liner 804, at a distance of 8.89 inches from the primary nozzle end 15.

Four rows, the overall decrease in diameter 812 of the mixing holes 802, the positioning of the mixing holes 802, and the number (fifteen) of mixing holes in each row 810*a-d* are all elements of the arrangement 800 that may impede fluid flow 24 penetration, and result in the less heterogeneous mixture 42 shown in FIG. 7. It should be appreciated that though these four rows 810*a-d* each include the same number of mixing holes 802 (fifteen), each individual row may include more or less mixing holes 802. It should also be appreciated that the arrangement 800 is intended to increase homogeneity, but may not be intended to maximize homogeneity of a fluid and fuel mixture. A mixture that is too homogeneous will decrease stability along with decreasing NOx emissions. The arrangement 800 decreases emissions while maintaining a balance between emissions and stability. Striking this balance (i.e. to making a mixture too homogeneous) is one reason why only some of the plurality of mixing holes 802 might be sized and positioned to impede fluid flow 24 penetration into the primary mixing zone 20.

Referring to FIGS. 17 and 18, two embodiments of a mixing hole arrangement 900 that will each allow for the improved less heterogeneous air and fuel mixture 42 shown in FIG. 7 is illustrated. FIGS. 17 and 18 illustrates tables 801 and 901 that represent positioning of the two embodiments of the mixing hole arrangement 900, each in a liner like liner 104 of FIG. 9. The arrangement 900 comprises a plurality of mixing holes represented in the tables 801 and 901 by a measure of diameter disposed in an appropriate row and column. At least one of this plurality of mixing holes of the arrangement 900 is at least one of sized (diameter) and positioned to impede fluid flow 24 penetration into the primary mixing zone 20 shown in FIG. 8.

The combustor 14 in this embodiment is a dry low NOx combustor (like that which is shown in FIG. 1), which may be for an 80 megawatt turbine. The mixing holes 902 are arranged in three rows, illustrated in tables 701 and 801 as a first column, a second column, and a third column. The mixing holes of the arrangement 900 in at least one of the three rows are sized (diameter) and positioned to impede airflow penetration of the fluid flow 24 into the fuel flow 30 and primary mixing zone 20. In this arrangement 900, mixing hole diameter varies in the first row and third row (represented in the first column and third column respectively of the tables 801 and 901). The mixing holes in the first row of both embodiments are positioned 20 degrees from each other around the liner, at a distance of between about 4.75 and 5.14 inches from the primary nozzle end 15 (as shown in FIG. 1). These mixing holes alternate between having a diameter of 0.784 inches and a diameter of 0.912 inches. The mixing holes 902 in the second row (represented in the second column of the tables 801 and 901) of both embodiments are positioned 20 degrees from each other around the liner, at a distance of 6.39 inches from the primary nozzle end 15. These mixing holes have a diameter of 0.85 inches. The mixing holes in the third row of both embodiments are positioned 20 degrees from each other around the liner, at a distance of from 7.64 to 8.15 inches from the primary nozzle end 15. These mixing holes alternate between having a diameter of 0.784 inches and a diameter of 0.912 inches.

Three rows, the overall decrease in diameter of the mixing holes in the arrangement 900, and the positioning of the mixing holes are all elements of the arrangement 900 that may impede fluid flow 24 penetration, and result in the less heterogeneous mixture 42 shown in FIG. 7. Impeding the fluid flow 24 via this arrangement 900 causes the fluid flow 24 in the second row to penetrate less than or equal to about 165% into the primary mixing zone 20, with an exemplary range of between about 150% and 165%, fluid flow 24 from holes in the first and third rows of the diameter of 0.74 inches to penetrate less than or equal to about 155% into the primary mixing zone 20, with an exemplary range of between about 140% and 155%, fluid flow 24 from holes in the first and third rows of the diameter of 0.912 inches to penetrate more than or equal to about 175% with an exemplary range of between about 175% and 185%. It should be appreciated that though these three rows each include the same number of mixing holes (twelve), each individual row may include more or less mixing holes. It should also be appreciated that the arrangement 900 is intended to increase homogeneity, but may not be intended to maximize homogeneity of a fluid and fuel mixture. A mixture that is too homogeneous will decrease stability along with decreasing NOx emissions. The arrangement 900 decreases emissions while maintaining a balance between emissions and stability. Striking this balance (i.e. to making a mixture too homogeneous) is one reason why only some of the plurality of mixing holes might be sized and positioned to impede fluid flow 24 penetration into the primary mixing zone 20.

It should be appreciated that a method for improving homogeneity of an air and fuel mixture in a combustor is also disclosed. The method includes impeding penetration of a fluid flow 24 into at least one of a fuel flow 30 and a primary mixing zone 20 of a head end 13 of the combustor 14. Impeding of the fluid flow 24 is achieved via at least one of a sizing of a mixing hole and a positioning of the mixing hole along a liner 12 of the combustor 14.

It should additionally be appreciated that another method for improving homogeneity of an air and fuel mixture in a combustor is further disclosed. This method includes impeding penetration of a fluid flow 24 into a fuel flow 30 and a primary mixing zone 20 of a head end 13 of a combustor 14, wherein the impeding is accomplished by sizing a plurality of mixing holes to include a predetermined diameter, and disposing the plurality mixing holes along a liner 12 of the combustor 14 in at least one of a predetermined position and a predetermined number. The disposing may further include positioning the plurality of mixing holes in at least three rows.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A mixing hole arrangement for improving homogeneity of an air and fuel mixture in a combustor, the mixing hole arrangement comprising:

a plurality of mixing holes defined by a liner, wherein at least one of said plurality of mixing holes is a mixing hole that is at least one of sized and positioned to impede penetration of a fluid flow into a primary mixing zone located in a head end of the combustor, wherein said impeding mixing hole allows said fluid flow to penetrate radially at least 100% and no more than 165% into said primary mixing zone, fluid flow penetrating over 100% travels radially outwardly from a centerbody of the combustor toward the liner.

2. An arrangement according to claim 1, wherein said plurality of mixing holes are disposed circumferentially around said liner in at least three rows.

3. An arrangement according to claim 2, wherein at least one of said at least three rows is positioned less than about 4.9 inches from a primary nozzle end of the combustor.

4. An arrangement according to claim 2, wherein said impeding mixing hole includes a diameter that is less than about 1.04 inches.

5. An arrangement according to claim 2, wherein said plurality of mixing holes are disposed in a first row, a second row, and a third row.

6. An arrangement according to claim 2, wherein at least one of said at least three rows is positioned less than about 6.39 inches from a primary nozzle end of the combustor.

7. An arrangement according to claim 2, wherein said impeding mixing hole includes a diameter that is less than about 1.125 inches.

8. An arrangement according to claim 2, wherein said plurality of mixing holes are disposed in a first row, a second row, and a third row, and each of said plurality of mixing holes disposed in each row are positioned about 30 degrees from each other, relative to a longitudinal central axis of the combustor.

9. An arrangement according to claim 2, wherein said plurality of mixing holes are disposed in a first row, a second row, a third row, and a fourth row, and each of said plurality of mixing holes disposed in each row are positioned about 24 degrees from each other, relative to a longitudinal central axis of the combustor.

10. An arrangement according to claim 2 wherein at least two rows each include a plurality of mixing holes numbering more than 4.

11. An arrangement according to claim 5, wherein said first row is positioned at less than about 4.9 inches from said primary nozzle end, and said plurality of mixing holes disposed in said first row include a diameter of at least about 0.59 inches and at most about 0.98 inches.

12. An arrangement according to claim 11, wherein each of said plurality of mixing holes disposed in said first row are positioned at least about 24 degrees and at most about 48 degrees from each other, relative to a longitudinal central axis of the combustor.

13. An arrangement according to claim 5, wherein said second row is positioned at less than about 6.15 inches from said primary nozzle end, and said plurality of mixing holes disposed in said second row include a diameter of at least about 0.59 inches and at most about 0.98 inches.

14. An arrangement according to claim 13, wherein each of said plurality of mixing holes disposed in said second row are positioned at least about 24 degrees and at most about 48 degrees from each other, relative to a longitudinal central axis of the combustor.

15. An arrangement according to claim 5, wherein said third row is positioned at least about 6.15 inches from said primary nozzle end, and said plurality of mixing holes disposed in said third row include a diameter of at least about 0.59 inches and at most about 1.39 inches.

16. An arrangement according to claim 15, wherein each of said plurality of mixing holes disposed in said third row are positioned at least about 24 degrees and at most about 48 degrees from each other, relative to a longitudinal central axis of the combustor.

17. An arrangement according to claim 8, wherein said first row is positioned as at less than about 6.39 inches from said primary nozzle end, and said plurality of mixing holes disposed in said first row include a diameter of at least about 0.714 inches and at most about 0.912 inches.

18. An arrangement according to claim 8, wherein said second row is positioned as less than about 6.39 inches from said primary nozzle end, and said plurality of mixing holes disposed in said second row include a diameter of at least about 0.714 inches and at most about 0.912 inches.

19. An arrangement according to claim 8, wherein said third row is positioned at least about 6.39 inches from said primary nozzle end, and said plurality of mixing holes disposed in said third row include a diameter of at least about 0.714 inches and at most about 0.912 inches.

20. An arrangement according to claim 9, wherein said plurality of mixing holes disposed in said first row, said second row, said third row, and said fourth row include a diameter of at most about 0.655 inches.

21. An arrangement according to claim 9, wherein said plurality of mixing holes included in each of said first row, said second row, said third row, and said fourth row numbers at least 15.

22. A method for improving homogeneity of an air and fuel mixture in a combustor, the method comprising:

impeding radial penetration of a fluid flow into at least one of a fuel flow and a primary mixing zone of the combustor, the fluid flow penetrating at least 100% and no more than 165% into said primary mixing zone, fluid flow penetrating over 100% travels radially outwardly from a centerbody of the combustor toward the liner.

23. A method according to claim 22, wherein said impeding includes impeding said fluid flow from a mixing hole into said fuel flow and said primary mixing zone of a head end of the combustor.

24. A method according to claim 23, wherein said impeding is achieved via at least one of a sizing of said mixing hole and positioning of said mixing hole along a liner.

25. A method for improving homogeneity of an air and fuel mixture in a combustor, the method comprising:

impeding radial penetration of a fluid flow from at least one of a plurality of mixing holes into a fuel flow and a primary mixing zone of a head end of the combustor, the fluid flow penetrating at least 100% and no more than 165% into said primary mixing zone, fluid flow penetrating over 100% travels radially outwardly from a centerbody of the combustor toward the liner, wherein said plurality of mixing holes are defined by the liner included in the combustor and said impeding is accomplished by:

sizing said plurality of mixing holes to include a predetermined hole diameter; and disposing said plurality mixing holes along said liner in at least one of a predetermined position and a predetermined number.

26. A method according to claim 25, wherein said disposing further includes circumferentially positioning said plurality of mixing holes in at least three rows around said liner.

* * * * *